US010897802B1

(12) United States Patent
Avery, Jr.

(10) Patent No.: US 10,897,802 B1
(45) Date of Patent: Jan. 19, 2021

(54) LINEAR LIGHTING WITH MULTIPLE INPUT VOLTAGES

(71) Applicant: Elemental LED, Inc., Reno, NV (US)

(72) Inventor: William H. Avery, Jr., Reno, NV (US)

(73) Assignee: Elemental LED, Inc., Reno, NV (US)

( * ) Notice: Subject to any disclaimer, the term of this patent is extended or adjusted under 35 U.S.C. 154(b) by 0 days.

(21) Appl. No.: 17/076,015

(22) Filed: Oct. 21, 2020

(51) Int. Cl.
*H05B 45/46* (2020.01)
*F21V 23/06* (2006.01)
*H05B 45/395* (2020.01)

(52) U.S. Cl.
CPC ..... *H05B 45/46* (2020.01); *H05B 45/395* (2020.01)

(58) Field of Classification Search
CPC ..... H05B 45/00; H05B 45/40; H05B 45/46; H05B 45/52; H05B 45/395; F21V 23/06; F21V 2107/60; F21V 2107/70; F21K 9/20; F21S 4/00; F21S 4/20; F21S 4/28
See application file for complete search history.

(56) References Cited

U.S. PATENT DOCUMENTS 8,297,788 B2 * 10/2012 Bishop ..... F21V 23/06 362/249.02
10,028,345 B2 7/2018 Petersen et al.

OTHER PUBLICATIONS

U.S. Appl. No. 17/002,028 filing date Aug. 25, 2020, Avery, Jr., Entire document.

* cited by examiner

*Primary Examiner* — Jimmy T Vu
(74) *Attorney, Agent, or Firm* — United IP Counselors, LLC

(57) ABSTRACT

Lighting circuits and strips of linear lighting that can accept either a lower voltage or a higher voltage are disclosed. In the lighting circuit, a repeating block including LED light engines and current-setting elements is divided into two sub-blocks. Terminals are provided that allow the sub-blocks to be connected to voltage and ground in various ways. When the two sub-blocks are connected electrically in parallel with one another, the lighting circuit accepts the lower voltage; when the two sub-blocks are connected electrically in series with one another, the lighting circuit accepts the higher voltage. Circuitry that automatically detects the applied voltage and switches between series and parallel configurations may be included in some embodiments.

22 Claims, 3 Drawing Sheets

LINEAR LIGHTING WITH MULTIPLE INPUT VOLTAGES

TECHNICAL FIELD

The invention relates to linear lighting capable of accepting multiple input voltages.

BACKGROUND

Linear lighting is a class of lighting based on light-emitting diodes (LEDs) in which an elongate, narrow printed circuit board (PCB) is populated with a plurality of LED light engines, typically spaced from one another at a regular pitch or spacing. In much of the linear lighting on the market, the LED light engines are surface-mounted on the PCB, along with other components. The PCB itself may be either rigid or flexible.

Combined with an appropriate power supply, linear lighting may be considered a luminaire (i.e., a finished light fixture) in its own right. It may also be used as a raw material for the manufacture of other, more complex, luminaires.

The most popular form of linear lighting is flexible, cuttable linear lighting. In this form of linear lighting, a flexible PCB is divided into repeating blocks at defined cut points. Each repeating block is a self-contained lighting circuit that will light if connected to power. The cut points allow a manufacturer or an installer to choose the desired length of linear lighting by cutting the flexible PCB at the desired cut point and connecting the resulting length of linear lighting to power.

Linear lighting is typically a low-voltage product, operating at, e.g., 12 or 24 volts, direct current (DC). Higher voltages bring certain advantages, primarily in the maximum usable length of a strip of linear lighting. Because of a phenomenon called Ohmic voltage drop, linear lighting operating at 24V will have a longer functional maximum length than linear lighting operating at 12V, all other things being equal.

Despite the advantages of higher-voltage product, most manufacturers still make linear lighting of different voltages. Separate product lines of 12V and 24V linear lighting are common, and some manufacturers make 48V linear lighting as well. Other manufacturers make 5V linear lighting that is compatible with USB chargers and other consumer electronics infrastructure. This means that manufacturers must stock a greater variety of products. The plethora of products with different voltages also places a burden on installers, who must carefully plan their installations to ensure that they are supplying the correct voltage to each strip of linear lighting. The consequences of supplying the wrong voltage can be serious—for example, a 12V strip supplied with 24V power will quickly overheat and burn out, potentially causing fire. On the other hand, a 24V strip supplied with 12V power may not light at all. Oftentimes, a product with an incorrect voltage for the installation must be torn out and replaced, which is a yet another burden on the installer, the manufacturer, and the building owner.

BRIEF SUMMARY

One aspect of the invention relates to a lighting circuit. The lighting circuit includes two sub-blocks, with each sub-block having one or more LED light engines and a current-setting element, such as a resistor. The sub-blocks are connected to four separate terminals such that the two sub-blocks can be connected electrically in parallel or electrically in series with one another. If the sub-blocks are connected in parallel with one another, the repeating block can accept a first, lower voltage. If the sub-blocks are connected in series with one another, the repeating block can accept a second, higher voltage.

In an embodiment according to another aspect of the invention, a diode with a low forward voltage may be connected between the second and third terminals such that when the two sub-blocks are to be connected in series, the second and third terminals are automatically connected to one another when the applied voltage exceeds the forward voltage of the diode.

In some embodiments according to this aspect of the invention, an automatic voltage detection mechanism and an automatic switching mechanism may be included in the lighting circuit such that the sub-blocks are automatically connected in parallel when the lower voltage is applied. This automatic switching mechanism may include, e.g., a transistor connecting the second terminal to ground and a transistor connecting the third terminal to the voltage. The gates of these two transistors are controlled by another pair of transistors whose gates are connected to voltage detection mechanisms, such that the transistors are only activated if the voltage in the circuit exceeds a threshold voltage. The voltage detection mechanisms may include Zener diodes. The threshold voltage is typically a voltage between the lower voltage and the higher voltage.

Yet another aspect of the invention relates to linear lighting. The linear lighting includes an elongate, narrow printed circuit board (PCB) that is divided into two or more repeating blocks at cut points. The repeating blocks are physically in series along the PCB but are electrically in parallel with one another between voltage and ground. In other words, the physical layout of the repeating blocks is linear, but they are electrically in parallel. Each repeating block has a lighting circuit as described above.

Other aspects, features, and advantages of the invention will be set forth in the description that follows.

BRIEF DESCRIPTION OF THE DRAWING FIGURES

The invention will be described with respect to the following drawing figures, in which like numerals represent like features throughout the description, and in which.

DETAILED DESCRIPTION

Figure 1:
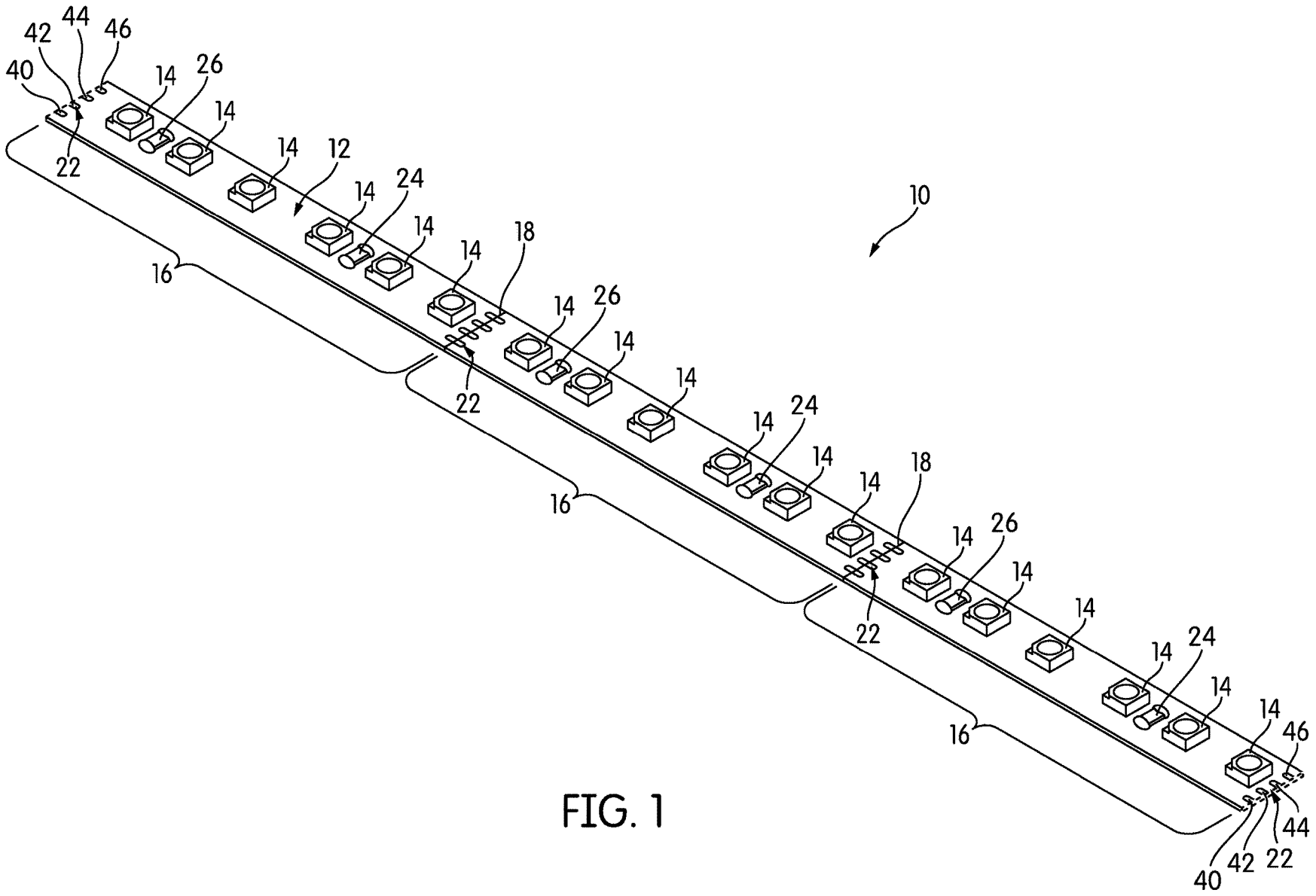
FIG. 1 is a perspective view of a strip of linear lighting according to one embodiment of the invention.

FIG. 1 is a perspective view of a strip of linear lighting, generally indicated at 10, according to an embodiment of the invention. The linear lighting 10 includes an elongate, narrow printed circuit board (PCB) 12, on which a plurality of LED light engines 14 are disposed, spaced from one another at a regular spacing or pitch.

As the term is used here, "LED light engine" refers to an element in which one or more light-emitting diodes (LEDs) are packaged, along with wires and other structures, such as electrical contacts, that are needed to connect the light engine to a PCB. If the light engine is intended to emit "white" light, it may be a so-called "blue pump" light engine in which a light engine containing one or more blue-emitting LEDs (e.g., InGaN LEDs) is covered with a phosphor, a chemical compound that absorbs the emitted blue light and re-emits a broader or a different spectrum of wavelengths. In the illustrated embodiment, the light engines are surface-mount devices (SMDs) soldered to the PCB 12, although other types of light engines may be used. The particular type of light engine is not critical, and other types of light engines may be used. While multi-color RGB LED light engines that emit a variety of colors may be used in embodiments of the invention, much of this description will assume that the LED light engines emit "white" light.

This description will assume that the strip of linear lighting 10 is a low-voltage, direct-current (DC) device. Definitions of "low voltage" vary according to the authority one consults. For purposes of this description, the term "low voltage" refers to any voltage under about 50V.

In FIG. 1, the PCB 12 is a flexible PCB made, for example, of a thin MYLAR® (biaxially-oriented polyethylene terephthalate) or polyimide film, although in some embodiments, it may be a rigid PCB made of a material like FR4, aluminum, or ceramic. The material of which the PCB is made is not critical, so long as it is suitable for the application in which the linear lighting 10 is to be used. While the LED light engines 14 and other devices on the PCB 12 are SMDs in the illustrated embodiment, other forms of mounting may also be used, including through-hole mounting.

The linear lighting 10 is divided into repeating blocks 16. Each repeating block 16 is a complete lighting circuit that will light if connected to power. The repeating blocks 16 can be separated from one another at cut points 18. In the illustration of FIG. 1, the cut points 18 are marked on the upper surface 20 of the PCB 12, e.g., by screen printing. However, in other embodiments, the cut points 18 may not be explicitly marked. When the cut points 18 are not explicitly marked, the locations of the cut points 18 can typically be deduced by using landmarks on the PCB 12. For example, in this case, the cut points 18 coincide with sets of solder pads, each of which is generally indicated at 22. While the term "solder pads" is used here for convenience, the sets of solder pads 22 may be used to make other types of electrical connections, such as connections using solderless electrical connectors. The term "solder pads" should be construed broadly to refer to electrical contacts.

Typically, most PCBs for linear lighting are on the order of 5-14 mm wide, although narrower and wider PCBs do exist. By joining sections of PCB 12 together at overlapping solder joints, a strip of linear lighting 10 may be made arbitrarily long. For example, 4 meter (16.4 foot) rolls of linear lighting are common in the industry, and 30 meter (100 foot) rolls of linear lighting are not unknown. Longer rolls of linear lighting 10 may be helpful for manufacturers and installers who use the product in great quantities; the functional maximum usable length (in industry parlance, the maximum run length) of any particular strip of linear lighting 10 may depend on a number of factors. The maximum run length specified by a manufacturer usually takes into account the effects of Ohmic voltage drop and any maximum power draw requirements imposed by local safety regulations. For example, a strip of linear lighting 10 operating at 24V may be limited to a 96 W power draw by local safety regulations.

In the embodiment of FIG. 1, each repeating block 16 includes six LED light engines 14 and two resistors 24, 26, although other embodiments could include any number of components, as will be described below in more detail.

The resistors 24, 26 of the linear lighting 10 are but one example of a broader class of current-setting elements. As those of skill in the art will appreciate, LED light engines 14 require some element to set the current in the circuit. This may be done in the power supply (i.e., in the driver), or it may be done by adding components to the PCB 12 itself to set the current. Linear lighting that is designed to be used with an external driver that controls the current flow is called "constant current" linear lighting. Linear lighting that is designed to control the current flow using its own on-board circuits is often referred to as "constant voltage" linear lighting. Constant-current linear lighting is often used when the length of the linear lighting is known in advance; constant-voltage linear lighting is more versatile and more easily used in situations where the length, and resulting current draw, is unknown or is likely to vary from one installation to the next. This description assumes that the linear lighting 10 is constant-voltage linear lighting; thus, the presence of the resistors 24, 26. Embodiments of the invention could be in constant-current form; this would typically involve omitting the resistors 24, 26. Moreover, in some embodiments, it may be advantageous to use current regulation integrated circuits instead of or alongside resistors.

Figure 2:
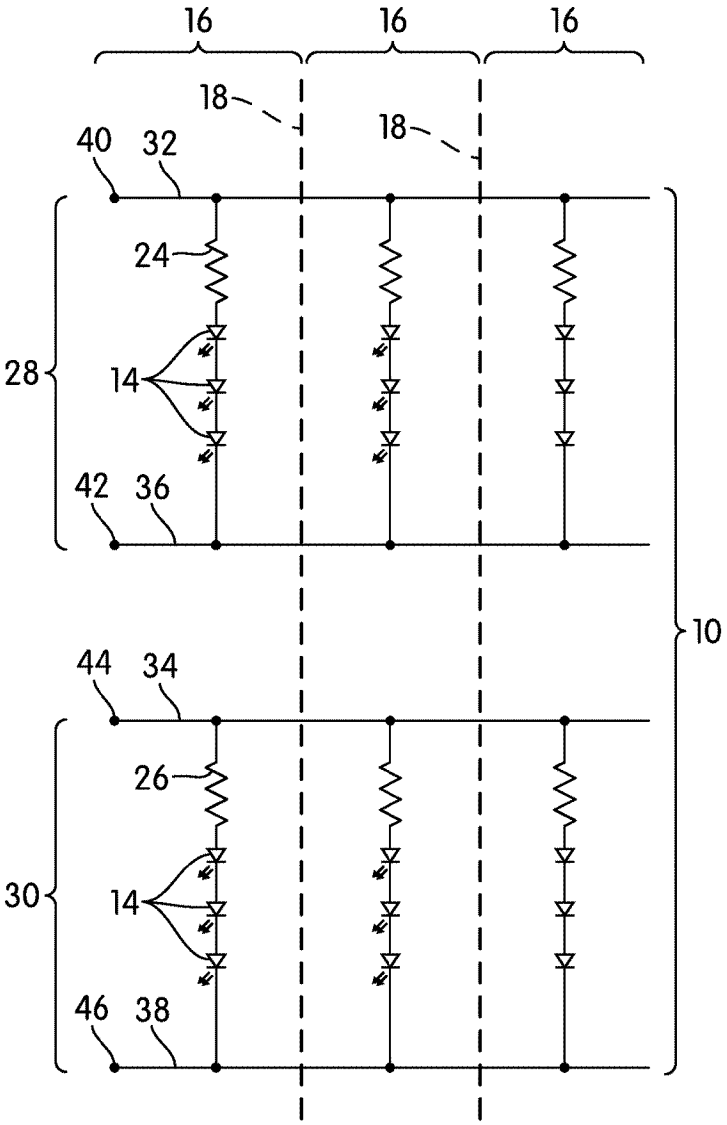
FIG. 2 is a schematic circuit diagram of the strip of linear lighting of FIG. 1.

FIG. 2 is a schematic circuit diagram of the linear lighting 10 of FIG. 1. As can be appreciated from FIG. 2, while the repeating blocks 16 are physically in series with one another, they are electrically in parallel with each other between the power source and ground. Physically, the PCB 12 is typically constructed as a two-layer board, with the lower layer a power bus with a number of conductor-lines that connect to each repeating block 16 and the upper layer dedicated to interconnecting conductors and other structure for a circuit like that of FIG. 2.

As can be seen in the diagram of FIG. 2, each of the repeating blocks 16 is divided into two sub-blocks 28, 30. In this embodiment, the two sub-blocks 28, 30 are identical, although they need not always be. Each sub-block 28, 30 has a power conductor 32, 34 and a minus-return or ground conductor 36, 38 located on the lower, power-bus layer of the PCB 12. Those four lines 32, 34, 36, 38 are connected to a corresponding set of four terminals, a first terminal 40, a second terminal 42, a third terminal 44, and a fourth terminal 46. These four terminals 40, 42, 44, 46 may comprise the set of solder pads 22 described above. The two sub-blocks 28, 30 in each repeating block 16 are electrically disconnected from one another. As will be described below in more detail, the two sub-blocks 28, 30 can be connected together in various ways using the four terminals 40, 42, 44, 46.

The linear lighting 10 of FIGS. 1 and 2 is designed to accept and operate on either of two direct-current voltages, a lower voltage or a higher voltage. This description will assume for the sake of explanation that these two voltages are 12V and 24V, although the actual voltage values are immaterial—the two voltages could be 24V and 48V, 5V and 10V, or some other voltages. The higher voltage need not be double the lower voltage, although in that case, the two sub-blocks 28, 30 would generally not be identical to one another.

Generally speaking, the linear lighting 10 is able to accept and operate on either of the two voltages because the four terminals 40, 42, 44, 46 can be connected such that the two sub-blocks 28, 30 are placed in parallel with one another when the lower voltage is applied or such that the two sub-blocks 28, 30 are in series with one another when the higher voltage is applied. In other words, when the lower voltage is applied, terminals 40 and 44 are connected together and power is applied to them while terminals 42 and 46 are connected together and serve as ground. This places the two sub-blocks 28, 30 electrically in parallel with each other. When the higher voltage is to be applied, it is applied to terminal 40, terminals 40 and 42 are connected together, and terminal 46 serves as ground. This places the two sub-blocks 28, 30 electrically in series with one another.

In the specific embodiment of FIGS. 1-2, the three LED light engines 14 in each sub-block 28, 30 are typical for a 12V LED lighting circuit, which assumes that each of the LED light engines 14 has a forward voltage in the range of about 3-3.3V. If the operating voltage or the forward voltages are different, there may be more or fewer LEDs. The resistors 24, 26 may be, e.g., 240Ω, surface-mount resistors, such as 0805 resistors. This amount of resistance sets the current in the circuit to about 20 mA, a typical current for an LED lighting circuit.

Assuming that the terminals 40, 42, 44, 46 comprise the set of solder pads 22, when connecting the strip of linear lighting 10 to power, an installer will choose a set of solder pads 22 and use lengths of wire or electrical connectors to connect to and between terminals 40, 42, 44, 46 as needed. In some cases, the PCB 12 may include elements like jumpers or DIP switches to make connecting between terminals 40, 42, 44, 46 easier.

While it is often assumed that an installer will use the set of solder pads 22 that is closest to one end of the strip of linear lighting 10 to make connections, that need not always be the case. Because of the arrangement of the repeating blocks 16 and the presence of a power bus within the strip of linear lighting 10, any set of solder pads 22 along the strip of linear lighting 10 may be used. Additionally, in many strips of linear lighting, conductors are accessible from the bottom of the strip; therefore, there is no requirement that the solder pads 22 or other such contacts be on the upper surface of the strip of linear lighting 10.

Furthermore, much of this description assumes that the strip of linear lighting 10 is powered from a single set of solder pads 22 at one end of the strip of linear lighting 10. This need not be the case in all embodiments. If desired, power could be input simultaneously in multiple places along the strip of linear lighting 10 using any of the sets of solder pads 22 found along its length. The advantage of powering the strip of linear lighting 10 in this way is that it the light output disparity between one end of the strip of linear lighting 10 and the other would be reduced, thereby extending the maximum run length.

Figure 3:
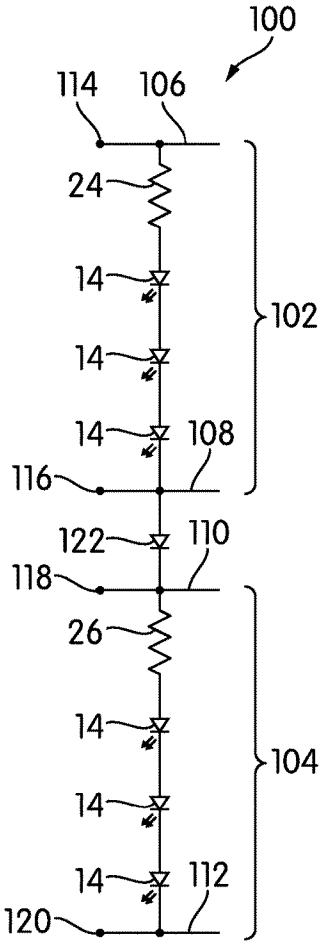
FIG. 3 is a schematic circuit diagram of a strip of linear lighting according to another embodiment of the invention.

FIG. 3 is a schematic circuit diagram of a single repeating block, generally indicated at 100, according to another embodiment of the invention. The single repeating block 100, like the repeating block 16 of FIGS. 1 and 2, has two sub-blocks 102, 104. Each sub-block 102, 104 in this embodiment has three LED light engines 14 and a resistor 24, 26, much like the previous embodiment. Additionally, there are four bus-lines 106, 108, 110, 112 that serve the repeating block 100 and all other repeating blocks 100, placing all repeating blocks 100 in a strip of linear lighting electrically in parallel with one another, although they are physically in series on the strip.

The four bus-lines 106, 108, 110, 112 terminate in four terminals 114, 116, 118, 120. The first terminal 114 serves as a main voltage input for the lower voltage or the higher voltage. The second terminal 116 serves as an auxiliary ground and the end of the first sub-block 102. The third terminal 118 serves as an auxiliary voltage input for the second sub-block 104, and the fourth terminal 120 serves as ground and as the end of the second sub-block 104.

The difference between the repeating block 16 described above and the repeating block 100 of FIG. 3 is that the two sub-blocks 102, 104 are not entirely electrically isolated from one another. Rather, they are connected through a diode 122. The diode 122 is not a light-emitting diode, although it is arranged in the circuit in the same way as the LED light engines 14 to be forward biased when the repeating block 100 is connected to power. The diode 122 bridges between the second terminal 116 and the third terminal 118. Typically, it has a low forward voltage, considerably lower than that of the LED light engines 14 themselves. For example, the diode 122 may have a forward voltage of about 0.7 volts.

In operation, the repeating block 100 and its terminals 114, 116, 118, 120 could be connected in the same way as the repeating block 16 described above. In particular, if the second terminal 116 and the third terminal 118 are connected by a wire, the diode 122 is simply bypassed. However, there is no need to connect the second terminal 116 and the third terminal 118; if the voltage is high enough, it simply passes from one sub-block 102 to the other sub-block 104. More specifically, if the lower voltage is applied, the first terminal 114 and the third terminal 118 are connected together, and the second terminal 116 and the fourth terminal 120 are connected together. This places the two sub-blocks 102, 104 electrically in parallel with one another to accept the lower voltage, and is not substantially different from the connections to the repeating block 16 described above.

The main distinction between the repeating block 100 and the repeating block 16 occurs when the higher voltage is applied. In this case, the voltage input is connected to the first terminal 114, the fourth terminal 120 is connected to ground or the negative side of the power source, and the second and third terminals 116, 118 are left floating. The applied voltage is assumed to be greater than the forward voltage of the diode 122, so current flows from the first sub-block 102 to the second sub-block 104 freely. As with the repeating blocks 16 described above, repeating block 100 may be repeated any number of times in a single strip of linear lighting.

Although the repeating block 100 of FIG. 3 simplifies the necessary connections, especially when the higher voltage is applied, the repeating block 100 still requires manual connections to be made depending on the voltage that is to be applied.

Figure 4:
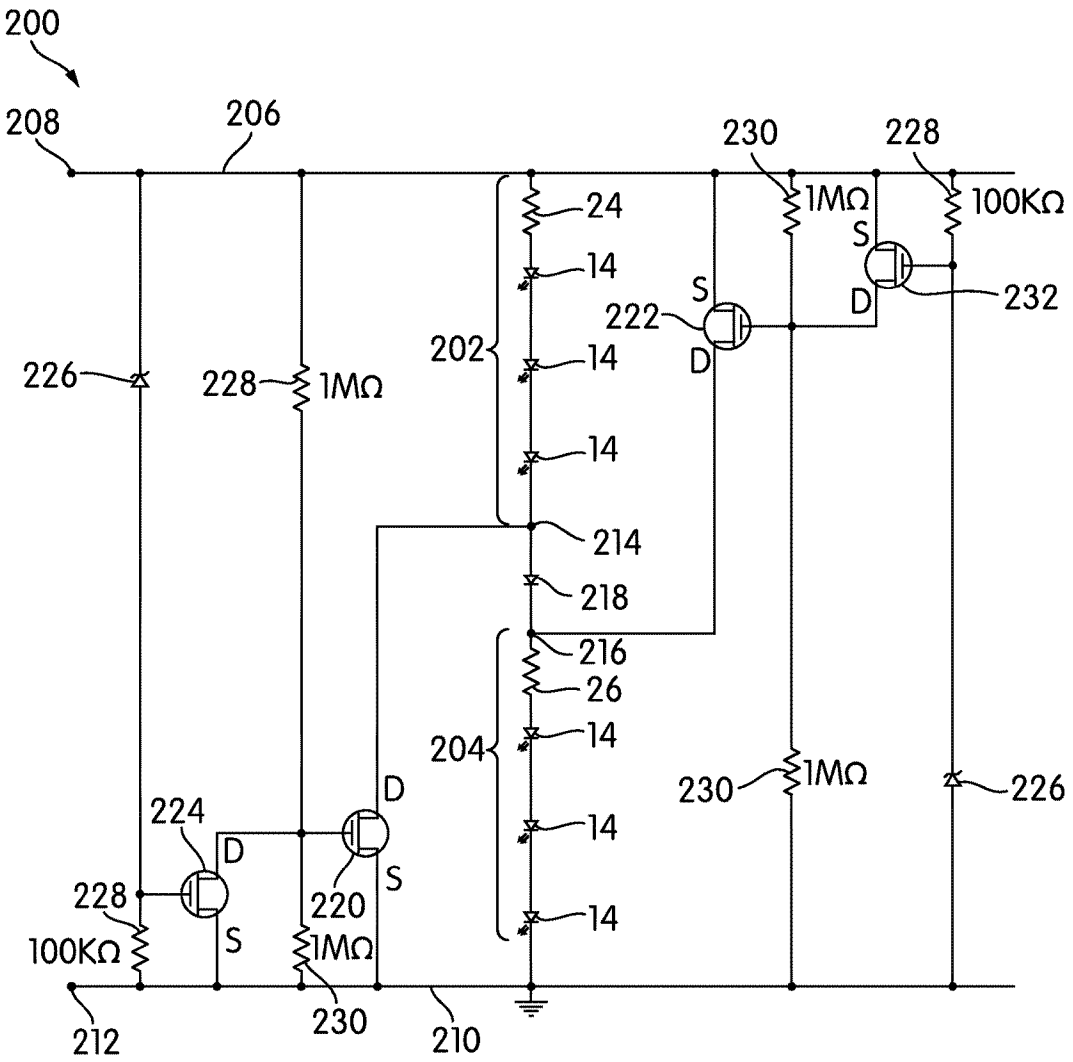
FIG. 4 is a schematic circuit diagram of a strip of linear lighting according to yet another embodiment of the invention.

FIG. 4 is a schematic circuit diagram of a repeating block 200 according to another embodiment of the invention. As with FIG. 3, only one repeating block 200 is shown in FIG. 4, although any number of repeating blocks 200 may be included in a strip of linear lighting, connected together in parallel. The repeating block 200 uses a voltage detection mechanism coupled to an automatic switching mechanism to detect the applied voltage and make appropriate connections depending on that applied voltage.

At the core of the repeating block 200 are a first sub-block 202 with three LED light engines 14 and a resistor 24, and a second sub-block 204 with three LED light engines 14 and a resistor 26. In the repeating block 200, there are two bus-lines, a first bus-line 206 with a terminal 208 that connects to voltage and a second bus line 210 with a terminal 212 that connects to ground. The two sub-blocks 202, 204 are thus always arranged between voltage and ground. The two terminals 208, 212, equivalent to the first and forth terminals 40, 46, 114, 120 of the repeating blocks 16, 100, and are assumed to be part of a set of solder pads, as described above.

There are also two internal terminals, which are referred to here as a second terminal 214 and a third terminal 216, for consistency with the nomenclature used above. The second terminal 214 and the third terminal 216 are not external terminals in this embodiment; that is, they would not be part of a set of solder pads or any other type of external connectors.

As with the repeating block 100 described above, there is a diode 218 connected between the second terminal 214 and the third terminal, i.e., between the first sub-block 202 and the second sub-block 204. The diode 218 may have a forward voltage of, e.g., 0.7 volts assuming that the higher voltage is 24V and the lower voltage is 12V. When the higher voltage is applied to the first terminal 208 and the fourth terminal 212 is connected to ground, the forward voltage of the diode 218 is exceeded and current flows through it, placing the two sub-blocks 202, 204 in series, just as described above.

Placing the two sub-blocks 202, 204 in parallel requires additional circuitry. In order to place the two sub-blocks 202, 204 in parallel, a switch is needed that connects the second terminal 214 to ground when the voltage is the lower voltage and disconnects the second terminal 214 from ground when the voltage is the higher voltage. Similarly, the third terminal 216 would be connected to the voltage bus line 206 when the applied voltage is the lower voltage and would be disconnected from the voltage bus line 206 when the voltage is the higher voltage.

In this embodiment, a first N-channel transistor 220 is arranged in the circuit such that its source is connected to the ground bus line 210 and its drain is connected to the second terminal 214. This performs the function of connecting the second terminal 214 to ground. Similarly, a first P-channel transistor 222 is arranged with its drain connected to the third terminal 216 and its source connected to the voltage bus line 206.

In this arrangement, another element is used to control the state of the two transistors 220, 222. Specifically, a second N-channel transistor 224 is arranged in the circuit such that its source goes to the ground bus line 210 and its drain goes to the gate of the first N-channel transistor 220. The gate of the second N-channel transistor 224 is connected to a voltage detection mechanism. Specifically, the gate of the second N-channel transistor 224 is connected to a 15V Zener diode 226. The Zener diode 226 of the illustrated maintains an open circuit for voltages below 15V. A 100 kΩ, resistor 228 in series with the Zener diode 226 ensures that any leakage current from the Zener diode 226 will not turn on the gate of the second N-channel transistor 224. Two large, 1 MΩ resistors 228 are arranged in series between the voltage bus line 206 and the ground bus line 210.

Because it is used as a voltage detection mechanism to distinguish between the lower voltage and the higher voltage, the Zener diode 226 preferably has a Zener voltage higher than the lower voltage and lower than the higher voltage. Since the illustrated embodiment assumes that the lower voltage is 12V and the higher voltage is 24V, the Zener diode 226 has a Zener voltage of 15V, as noted above.

The other side of the circuit is a mirror-image inverse of the first side: a second P-channel transistor 232 is arranged in the circuit such that its source is connected to the voltage bus line 206 and its drain is connected to the gate of the first P-channel transistor 222 to control the first P-channel transistor 222. Two large, 1 MΩ resistors 230 in series are arranged in the circuit between the voltage bus line 206 and the ground bus line 210. The gate of the second P-channel transistor 232 is connected to a voltage detection mechanism that comprises a 15V Zener diode 226 with a 100 kΩ resistor 228 in series to prevent leakage current from the Zener diode 226 from activating the gate of the P-channel transistor 232.

With this arrangement, when the input voltage is 12V, the Zener diodes 226 are off. Therefore, on the first side of the circuit, the second N-channel transistor 230 is off. The two 1 MΩ resistors 230 place about one-half of the input voltage between the gate and the source of the first N-channel transistor 220. Since the threshold voltage of the first N-channel transistor 220 would typically be on the order of 2V for a 12/24V circuit, the first N-channel transistor 220 is normally on for 12V or 24V unless the input voltage rises high enough for the second N-channel transistor 224 to shut the first N-channel transistor 220 off. The operation is the same for the P-channel FETs 222, 232 on the other side of the circuit, which require negative voltages between source and gate to turn on. In this way, when the input voltage is the lower voltage, the two sub-blocks 202, 204 are automatically placed electrically in parallel with one another, while when the input voltage is the higher voltage, the two sub-blocks 202, 204 are automatically placed in series with one another.

While the invention has been described with respect to certain embodiments, the description is intended to be exemplary, rather than limiting. Modifications and changes may be made within the scope of the invention, which is defined by the appended claims.

What is claimed is:

1. A lighting circuit, comprising:

a first sub-block including one or more first LED light engines, at least one first current-setting component, a first terminal electrically connected to the one or more first LED light engines and the at least one first current-setting component for applying a voltage to the first sub-block, and a second terminal electrically connected to the one or more first LED light engines and the at least one first current-setting component for applying a ground or minus-return to the first sub-block; and a second sub-block, the second sub-block including one or more second LED light engines, at least one second current-setting component, a third terminal electrically connected to the one or more second LED light engines and the at least one second current-setting component for applying a voltage to the second sub-block, and a fourth terminal electrically connected to the one or more second LED light engines and the at least one second current-setting component for applying a ground or minus-return to the second sub-block;

wherein the first terminal, the second terminal, the third terminal, and the fourth terminal are connectable such that the first sub-block and the second sub-block are connected electrically in series or electrically in parallel with respect to one another.

2. The lighting circuit of claim 1, wherein the lighting circuit is adapted to accept a lower voltage when the first sub-block and the second sub-block are connected electrically in parallel with one another and a higher voltage when the first sub-block and the second sub-block are connected electrically in series with one another.

3. The lighting circuit of claim 2, wherein the lower voltage is 12V and the higher voltage is 24V.

4. The lighting circuit of claim 3, wherein:

the one or more first LED light engines comprise three LED light engines;

the one or more second LED light engines comprise three LED light engines; and the at least one first current-setting component and the at least one second current-setting component each comprise at least one resistor.

5. The lighting circuit of claim 2, further comprising a diode connected between the second terminal and the third terminal, arranged such that current flows between the second terminal and the third terminal when a forward voltage of the diode is exceeded.

6. The lighting circuit of claim 5, wherein the forward voltage of the diode is less than a forward voltage of one of the LED light engines.

7. The lighting circuit of claim 5, further comprising:

a first transistor arranged to selectively connect the second terminal to ground when the lower voltage is applied to the lighting circuit; and a second transistor arranged to selectively connect the third terminal to voltage when the lower voltage is applied to the lighting circuit.

8. The lighting circuit of claim 7, further comprising:

a third transistor having a source connected to ground, a drain connected to a gate of the first transistor, and a gate coupled to the voltage through a first voltage detection diode; and a fourth transistor having a source connected to voltage, a drain connected to a gate of the second transistor, and a gate coupled to the voltage through a second voltage detection diode.

9. The lighting circuit of claim 8, wherein the first transistor and the third transistor are N-channel transistors and the second transistor and the fourth transistor are P-channel transistors.

10. The lighting circuit of claim 9, wherein the first voltage detection diode and the second voltage detection diode comprise Zener diodes.

11. Linear lighting, comprising:

an elongate, narrow printed circuit board (PCB) divided into two or more repeating blocks at cut points, the two or more repeating blocks being physically in series and electrically in parallel with one another, each of the two or more repeating blocks including a first sub-block including one or more first LED light engines, at least one first current-setting component, a first terminal electrically connected to the one or more first LED light engines and the at least one first current-setting component for applying a voltage to the first sub-block, and a second terminal electrically connected to the one or more first LED light engines and the at least one first current-setting component for applying a ground or minus-return to the first sub-block, and a second sub-block, the second sub-block including one or more second LED light engines, at least one second current-setting component, a third terminal electrically connected to the one or more second LED light engines and the at least one second current-setting component for applying a voltage to the second sub-block, and a fourth terminal electrically connected to the one or more second LED light engines and the at least one second current-setting component for applying a ground or minus-return to the second sub-block;

wherein the first terminal, the second terminal, the third terminal, and the fourth terminal are connectable such that the first sub-block and the second sub-block are connected electrically in series or electrically in parallel with respect to one another.

12. The linear lighting of claim 11, wherein the PCB is flexible.

13. The linear lighting of claim 11, wherein the PCB is rigid.

14. The linear lighting of claim 11, wherein the linear lighting is adapted to accept a lower voltage when the first sub-block and the second sub-block of each of the two or more repeating blocks are connected electrically in parallel with one another and a higher voltage when the first sub-block and the second sub-block of each of the two or more repeating blocks are connected electrically in series with one another.

15. The linear lighting of claim 14, wherein the lower voltage is 12V and the higher voltage is 24V.

16. The linear lighting of claim 15, wherein, in each of the two or more repeating blocks:

the one or more first LED light engines comprise three LED light engines;

the one or more second LED light engines comprise three LED light engines; and the at least one first current-setting component and the at least one second current-setting component each comprise at least one resistor.

17. The linear lighting of claim 14, each of the two or more repeating blocks further comprising a diode connected between the second terminal and the third terminal, arranged such that current flows between the second terminal and the third terminal when a forward voltage of the diode is exceeded.

18. The linear lighting of claim 17, wherein the forward voltage of the diode is less than a forward voltage of one of the LED light engines.

19. The linear lighting of claim 17, each of the two or more repeating blocks further comprising:

a first transistor arranged to selectively connect the second terminal to ground when the lower voltage is applied to the lighting circuit; and a second transistor arranged to selectively connect the third terminal to voltage when the lower voltage is applied to the lighting circuit.

20. The linear lighting of claim 19, each of the two or more repeating blocks further comprising:

a third transistor having a source connected to ground, a drain connected to a gate of the first transistor, and a gate coupled to the voltage through a first voltage detection diode; and a fourth transistor having a source connected to voltage, a drain connected to a gate of the second transistor, and a gate coupled to the voltage through a second voltage detection diode.

21. The linear lighting of claim 20, wherein the first transistor and the third transistor are N-channel transistors and the second transistor and the fourth transistor are P-channel transistors.

22. The linear lighting of claim 21, wherein the first voltage detection diode and the second voltage detection diode comprise Zener diodes.

* * * * *